United States Patent [19]

Saltzman

[11] 4,001,997

[45] Jan. 11, 1977

[54] MOLDED SIDING MEMBER

[76] Inventor: Jerry E. Saltzman, 3022 Shore Road, Bellmore, N.Y. 11710

[22] Filed: Jan. 3, 1975

[21] Appl. No.: 538,391

[52] U.S. Cl. ..... 52/521; 52/542; 52/547; 52/555

[51] Int. Cl.[2] ..... E04D 3/362; E04D 3/32

[58] Field of Search ..... 52/520, 521, 526, 555, 52/536, 539, 542, 547

[56] References Cited

UNITED STATES PATENTS

| | | | |
|---|---|---|---|
| 121,438 | 11/1871 | Wands | 52/547 |
| 1,993,086 | 3/1935 | Chaffee | 52/535 X |
| 2,156,277 | 5/1939 | Corbin, Jr. | 52/526 X |
| 2,735,143 | 2/1956 | Kearns | 52/521 |
| 2,787,349 | 4/1957 | Kretschmar | 52/521 |
| 3,667,187 | 6/1972 | Jeret | 52/521 X |
| 3,862,532 | 1/1975 | Markos | 52/521 |

*Primary Examiner*—Alfred C. Perham
*Attorney, Agent, or Firm*—Davis, Hoxie, Faithfull & Hapgood

[57] ABSTRACT

A molded siding member for use on buildings composed of a plurality of vertically extending panels connected side by side by intervening webs to simulate a horizontal course of spaced shingles, the member being formed along its upper margin with nail receiving recesses molded into its exterior surface to form bosses protruding inwardly a predetermined distance to engage the side of the building and thereby provide a predetermined spacing of the said upper margin outwardly from the side of the building when the member is nailed in place, the member being formed with protruding portions extending downwardly below its lower margin to form locking tongues adapted to be inserted in the space between the building and the upper margin of the next lower member to lock the lower margin of the upper member in place in readiness for a simple nailing operation at its upper margin.

7 Claims, 11 Drawing Figures

MOLDED SIDING MEMBER

BACKGROUND OF THE INVENTION

Molded siding members simulating courses of shingle shakes in building construction as an inexpensive way of affording attractive exterior wall surfaces have been known heretofore. My invention seeks to improve the construction of such molded siding members to the end that their manufacture is simplified, their installation is facilitated and their performance over the many years of use required of such structural members is enhanced.

SUMMARY OF THE INVENTION

In applying a siding member, it is convenient to work upwardly from the base of the wall and, conventionally, after the lowermost member has been applied, the next member to be applied above it is first secured to the lower member and then nailed in place along its upper margin. One object of my invention is to provide improved means for securing the two members to each other and to the wall. As herein disclosed, the member has nail receiving recesses molded into the exterior surface to form bosses protruding rearwardly a predetermined distance from the interior surface, thereby providing a predetermined spacing of the upper margin outwardly from the side of the building when the member is nailed in place. The member has protruding portions extending downwardly below its lower margin forming locking tongues adapted to be inserted in the spaces between the building and the upper margin of a lower member to lock the lower margin of the upper member in place preparatory to nailing its upper margin. In use, this fastening is accomplished rapidly, a significant cost savings in construction work, by simply positioning the upper member with a downward motion, thereby inserting its tongues in the spaces and automatically positioning and holding it for a simple nailing operation at the top.

Changes in temperature from season to season and day to night cause expansion and contraction of siding members, which it is an object of my invention to accommodate. The bottom lock affords sliding engagement which, together with freedom of movement afforded by the nail apertures at the top, permit such dimensional changes.

It is my further object to allow for air circulation between the wall and the siding member to avoid mold and rot, which is readily accomplished by the openings afforded by the construction described herein.

It is a still further object of my invention to provide adequate strength in a molded siding member which for reasons of economy would otherwise be unduly fragile, and this I have accomplished by the flanged and bossed construction which at the same time affords proper sloping and spacing of the siding from the building and from contiguous lower siding members.

Figure 1:
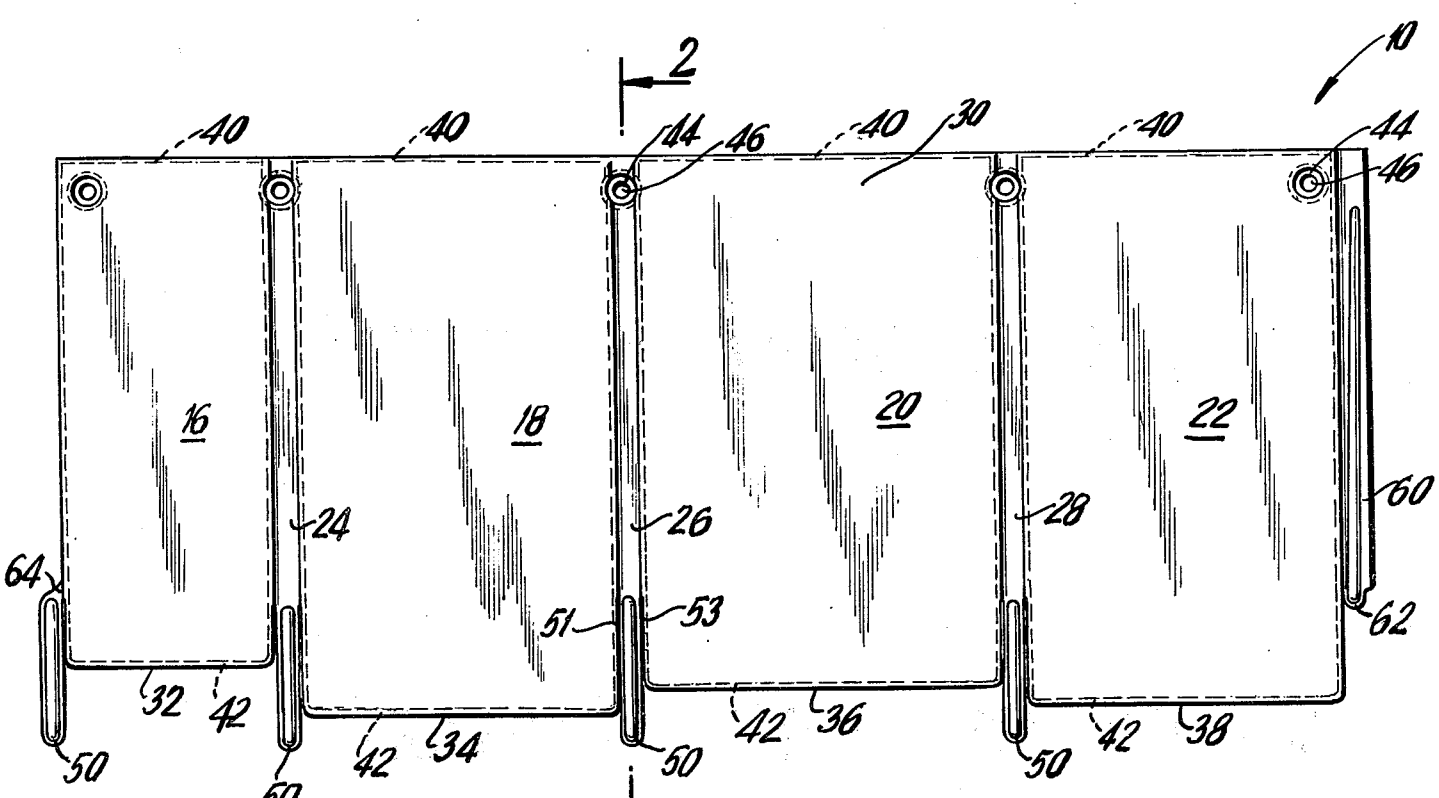
FIG. 1 is a front elevation view of my novel siding member.
Figure 3:
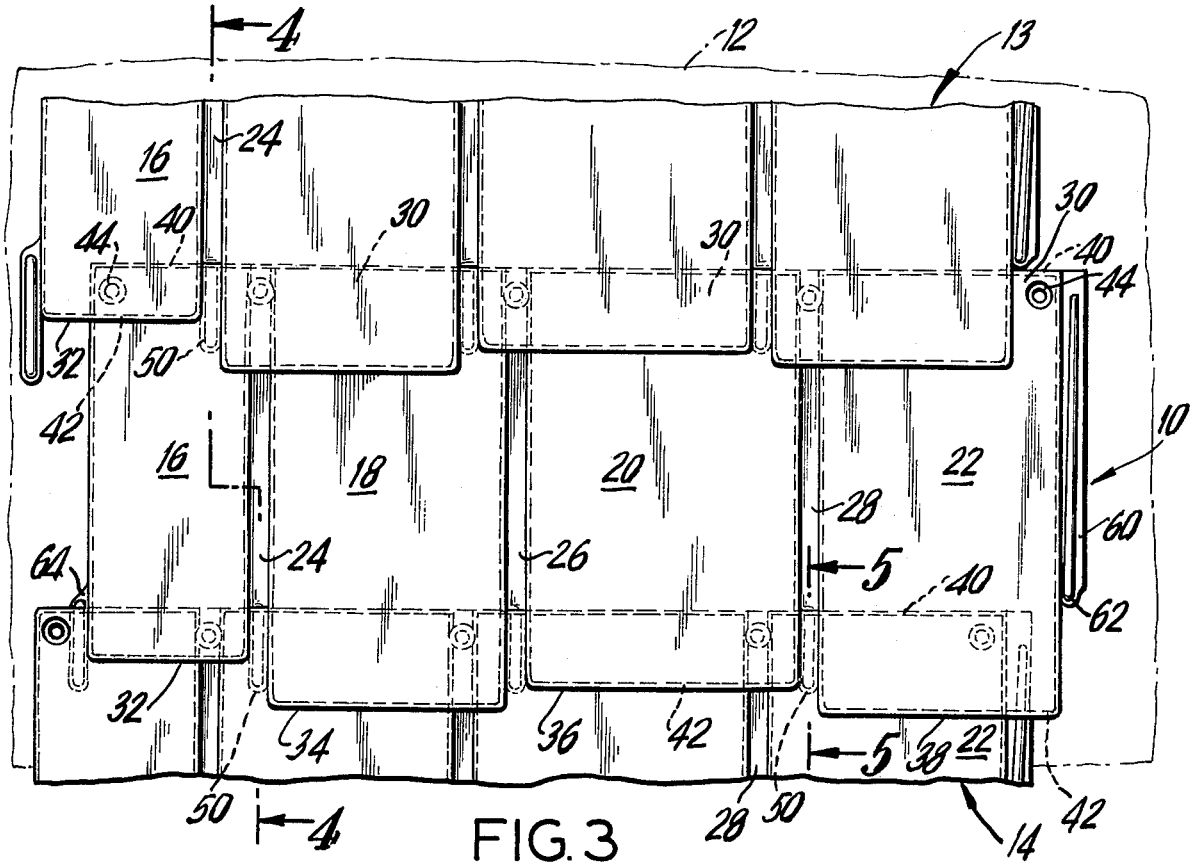
FIG. 3 is an elevation view of a plurality of superimposed siding members in accordance with my invention.

In FIG. 1 a typical siding member embodying my invention is shown at 10. In FIG. 3 the member is shown suitably secured in place, as will be described, on the wall 12 between upper and lower like members 13 and 14, respectively. The member is formed of a plurality of panels 16, 18, 20 and 22 separated by intervening webs 24, 26 and 28, as indicated. The panels extend vertically to a uniform height terminating in the upper margin 30 of the member. The panels extend downwardly to different levels indicated, respectively, at 32, 34, 36 and 38 in the lower margin of the member and thereby the siding member simulates shingles of random lengths. The member is preferably formed by molding an appropriate durable, weather resistant plastic such as polyethylene or the like. In forming the material by molding, its exterior surface may be provided with ornamentation comparable to the natural fibrous texture of weathered shingles or with other ornamentation as desired.

Figure 2:
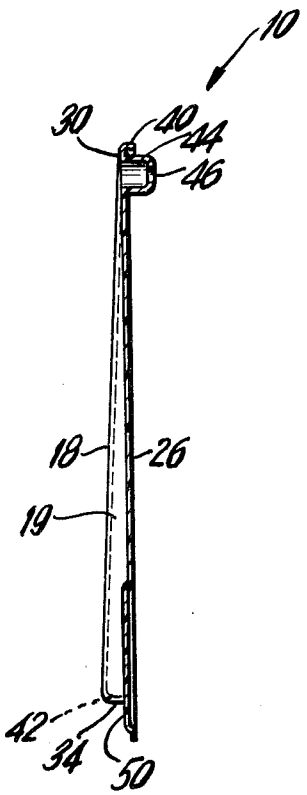
FIG. 2 is a vertical section on the line 2—2 of FIG. 1.
Figure 4:
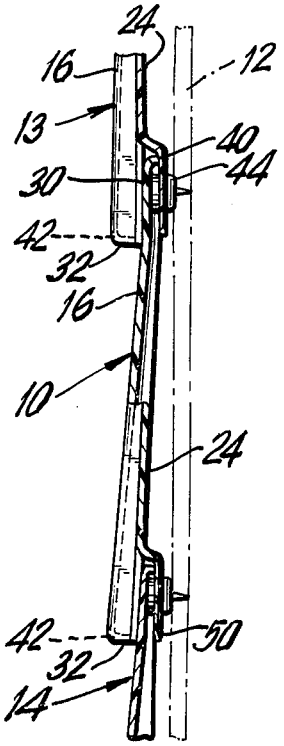
FIG. 4 is a vertical section taken on the line 4—4 of FIG. 3.
Figure 5:
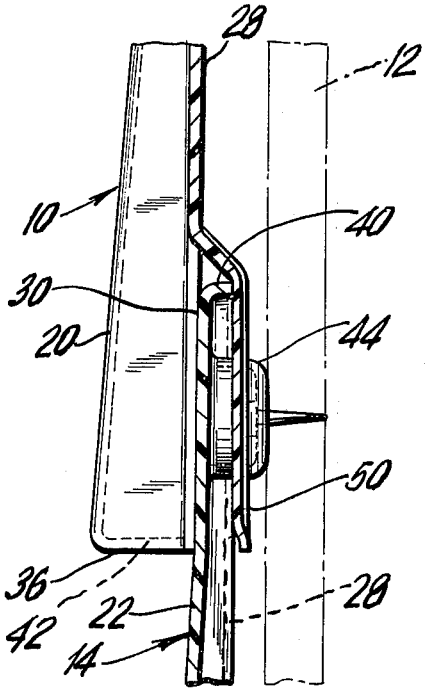
FIG. 5 is an enlarged vertical section on the line 5—5 of FIG. 3.

In the molding operation the siding member is formed as an integral unit composed of any desired number of panels, of which four have been shown for illustrative purposes, successively joined by the intervening webs. The panels, for a purpose which will appear, are molded with inturned flanges at their upper and lower margins as indicated by the upper flange 40 (FIG. 2) and the lower flange 42 of the panel 18, which may be considered typical. The plastic is depressed below the body of the panel to form the connecting webs 24, 26 and 28, which, when the panel member is installed, may slope downwardly and outwardly at a slight inclination due to the overlap of the next lower panel as indicated in FIG. 4. The main body of the panel slopes downwardly and outwardly at a greater angle as indicated by the panel 16 in FIG. 4. The web is thus countersunk below the surface of the panel body with a recess that is deeper at the bottom of the member than at the top due to the difference in the angles of inclination. The web and the main body are integrally connected by the side member 19 (FIG. 2).

The downward and outward slope of the main body of the siding member simulates shingles that are thicker at their bottom than at their top edges, and the bottom flanges 42 may have different widths in different panels to simulate shingles having lower ends of random thicknesses. Similarly, the lower margins of successive panels may terminate at different heights, as indicated, to simulate shingles of random lengths. Further, the panels may vary in width, as shown, to simulate natural shingles in that respect as well.

In the molding, nailing recesses are formed, preferably one at the upper margin of each connecting web, forming bosses 44 which protrude inwardly from the interior surface of the member. Each boss is formed with a nail hole 46 (FIG. 2) in its bottom surface for passage of a nail, and, for accommodation of expansion and contraction due to temperature changes, I preferably enlarge the hole for relative movement between the siding member and the securing nail. The bosses thus formed protrude inwardly a predetermined distance to engage the side of the building and thereby provide a predetermined spacing of the upper margin of the member outwardly from the side of the building when the member is nailed in place. This distance desirably, although not necessarily, is uniform for all bosses in each member.

The siding member is formed with protruding portions 50 extending downwardly below its lower margin preferably as an integral extension of each web. These extensions are separated from the body of the siding member as though cut away for a small distance on each side 51 and 53, thus forming an elongated bendable locking tongue for retaining the bottom of the siding member throughout a slight distance upwardly of its lower margin, as will appear.

The lateral sides of the siding member are formed for inter-engagement of one siding member with the next siding members laterally placed on each side in forming a continuous lateral course. To that end, the member may be formed as indicated at the right of FIG. 1 with a flange 60 protruding outwardly and extending downwardly a predetermined distance short of the extreme lower edge of the member as indicated at 62. The flange 60 may desirably be of the same width as the connecting webs and similarly countersunk. On its opposite edge as shown on the left in FIG. 1, the member has a flange-like element 64 protruding downwardly from a distance below the upper edge of the panel 16 approximating the distance downwardly of the edge 62 of flange 60 from the upper edge of panel 22. The flange-like element 64 is countersunk below the surface of the panel 16 to lie in the same plane as the flange 60 and thus the flange-like element 64 of one member mates with the flange 60 of another when the right side of one member is abutted against the left side of the adjoining member.

Siding members constructed in accordance with my invention as above described may be securely installed on the wall of a building with facility and a minimum of breakage. Referring to FIG. 3, the lowermost siding member 14 is first installed and secured in place by nails driven in through the holes of the nailing recesses. The bosses protruding from the back of the lower member 14 hold its upper margin securely in place in spaced relation from the surface of the wall by a distance equal to the height of the bosses. Suitable trim (known in the trade as a starter strip) of the type conventionally used with siding may be employed to conceal the bottom edge of the lowermost siding member and give a trim appearance.

The next member to be installed is the member 10 forming part of the course lying above the member 14. It is installed so its lower margin overlaps the upper margin of the member 14. To install the member 10, it is simply grasped at both ends, put against the wall and brought down with a sliding motion to insert the downwardly protruding tongues (out of alignment with the bosses protruding from the upper margin of the lower member 14) in the space between the wall and the lower member which the bosses of the latter provide. During this operation the tongues will readily bend inwardly to accommodate the flange 40 of the lower member and then downwardly as they slide against the wall, — the bending being facilitated by the cuts 51 and 53. Having thus been secured at its lower margin, the upper margin of the member 10 is simply nailed in place.

This process continues until the wall is filled, using the inter-locking side flanges for continuing the courses laterally. Corner posts and channels may be used for corner and top trim as is conventional.

In service, the siding member accommodates expansion and contraction upon thermal changes by the enlarged nail holes along the upper margins and the sliding fit of the protruding tongues at the lower margins. The upper and lower flanges 40 and 42 not only give the desired slope, but also serve to enhance the strength of the siding member which is in the interest of conservation of molded plastic without undue fragility. The openings along the panel at the bottom afford access of air between the wall and the panel to minimize rot and mold.

Figure 6:
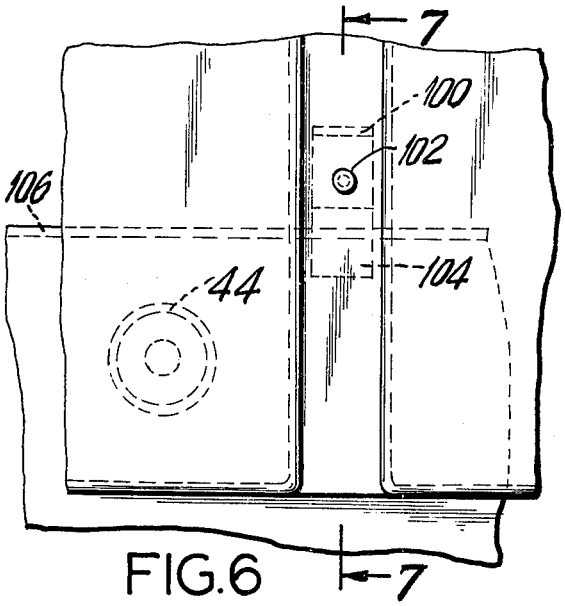
FIG. 6 is a detail elevation of a modification.
Figure 7:
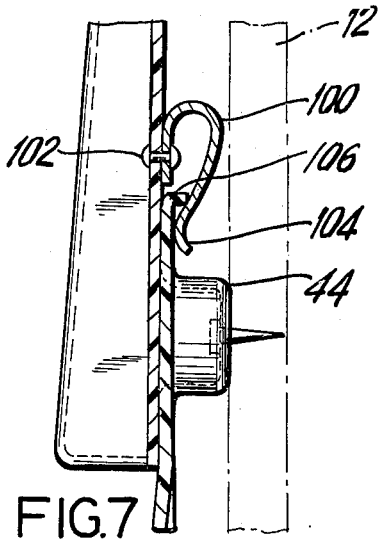
FIG. 7 is a vertical section on the line 7—7 of FIG. 6.

The preferred embodiment of my invention as above described may be variously modified. As indicated in FIGS. 6 and 7, the locking tongue construction may be replaced by a metal spring clip 100 suitably riveted or otherwise secured at 102 in the connecting web and formed to turn downwardly with a reverse lip 104 to lock over the upper flange 106 of the lower member in the space between it and the wall.

Figure 8:
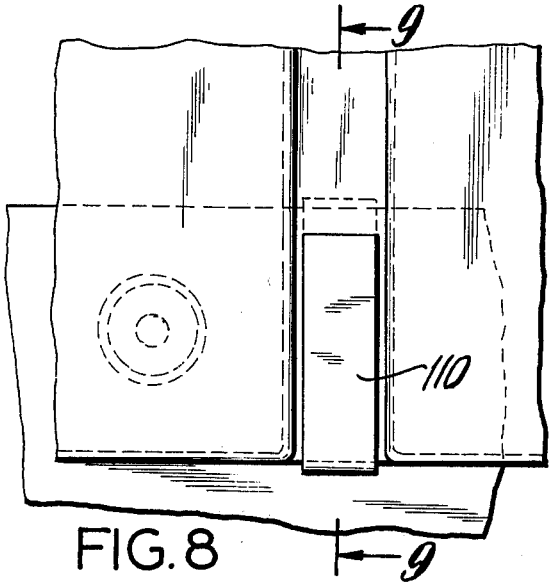
FIG. 8 is a detail elevation of a further modification.
Figure 9:
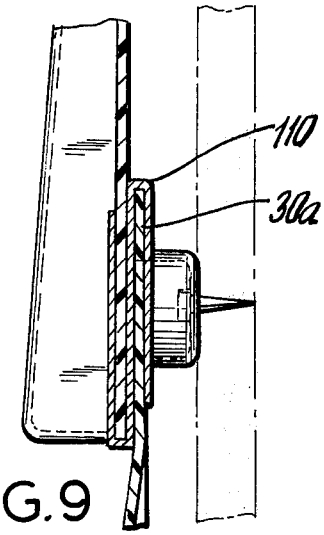
FIG. 9 is a vertical section on the line 9—9 of FIG. 8.
Figure 10:
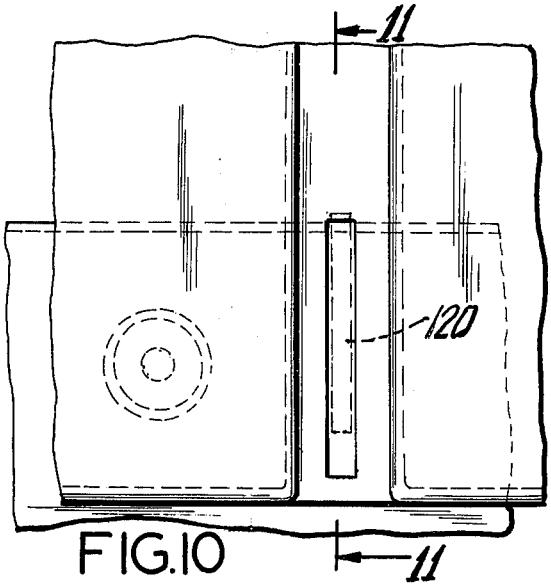
FIG. 10 is a detail elevation of a still further modification.
Figure 11:
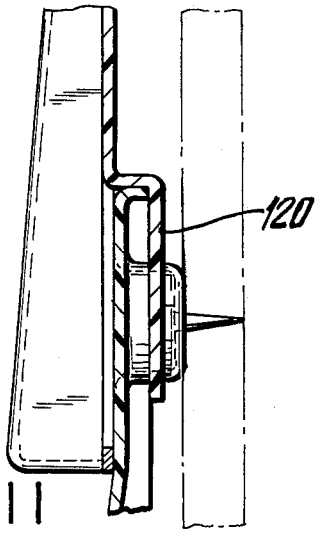
FIG. 11 is a vertical section on the line 11—11 of FIG. 10.

As indicated in FIGS. 8 and 9, the locking tongue may be replaced by a Z-shaped spring clip 110. In this embodiment the flange 40 is omitted from the upper margin **30*a* of the siding member which slides into the Z-clip as shown. In the construction of FIGS. 10 and 11, an L spring clip 120** of metal takes the place of the locking tongue.

I claim:

1. A molded siding member for use on buildings composed of a plurality of vertically extending panels connected side by side by intervening webs to simulate a horizontal course of shingles and having exterior and interior surfaces, the said webs being countersunk below the exterior surfaces to simulate spaces between adjacent shingles, each course being positionable with its lower margin overlapping the upper margin of the next lower course, the member being formed along its upper margin with a plurality of nail receiving recesses molded into the exterior surface to form widely separated bosses protruding inwardly a predetermined distance from the interior surface of the siding member and its upper margin to engage the side of the building and thereby provide a predetermined spacing of the said upper margin outwardly from the side of the building when the member is nailed in place, the member being formed with protruding portions extending downwardly below its lower margin and inwardly of the web surface to form locking tongues adapted to be inserted in the opening afforded by said predetermined spacing between the building and the upper margin of the next lower member to lock the lower margin of the upper member in place, the said tongues originating above the said lower margin and being separated therefrom to accommodate the said overlap.

2. The molded siding member of claim 1 in which:

the lower margins of the panels turn inwardly to present flanges of predetermined width adapted to rest against the upper margin of the next lower member and thereby determine the spacing of the said lower margin outwardly from the said upper margin of the next lower member, so that the panel slopes outwardly and downwardly in simulation of a shingle thicker at the bottom than the top.

3. The molded siding member of claim 2 in which the lowermost margins of the panels having their inturned flanges at different distances downwardly from the upper margin of the member to simulate shingles of random lengths.

4. The molded siding member of claim 2 having its upper margin inturned to present flanges, the said flanges inturned from the upper and lower margins being adapted to strengthen the member at its upper and lower margins.

5. The molded siding member of claim 1 in which one of its side panels is of a predetermined length downwardly from said upper margin and has an edge formed as a laterally protruding flange extending downwardly from the said upper margin by a limited dimension less than said predetermined length, the member having its opposite side edge formed as a laterally protruding flange extending downwardly from said limited dimension below said upper margin and terminating in a said protruding portion to form a locking tongue, the said side edges of a plurality of such members being adapted to mate as they are placed in lateral alignment in covering a wall.

6. The molded siding member of claim 1 in which the said protruding portions extending downwardly to form locking tongues are formed as integral extensions of the said webs.

7. The molded siding member of claim 2 in which the side protruding portions extending downwardly to form locking tongues are formed as integral extensions disposed inwardly by countersinking of the said webs.

* * * * *